US006158191A

United States Patent [19]

Seem

[11] Patent Number: 6,158,191

[45] Date of Patent: Dec. 12, 2000

[54] ROOF PANEL WITH PLOW-SHAPED EDGE AND RELATED ROOF PANEL SYSTEM

[76] Inventor: Charles T. Seem, 585 Blue Mountain Rd., Cherryville, Pa. 18035

[21] Appl. No.: 09/348,117

[22] Filed: Jul. 2, 1999

[51] Int. Cl.[7] ..... B65B 51/26

[52] U.S. Cl. ..... 52/746.11; 52/413

[58] Field of Search ..... 52/411, 412, 413, 52/478, 539, 309.5, 409, 578, 746.11; 156/71

[56] References Cited

U.S. PATENT DOCUMENTS

| | | | |
|---|---|---|---|
| 1,608,324 | 11/1926 | Knox | 52/413 X |
| 2,872,882 | 2/1959 | Paul | 52/411 X |
| 5,277,011 | 1/1994 | Serrano Martin | 52/539 X |
| 5,394,672 | 3/1995 | Seem | 52/746.11 X |

*Primary Examiner*—Jerry Redman
*Attorney, Agent, or Firm*—Sanford J. Piltch, Esq.

[57] ABSTRACT

A multiple-panel roof system has panel edges in a shape of like plows which are interengaged with corresponding channels formed in opposing panel edges. A layer of resiliently compressible foam extends from the outer panel surface adjacent to the plow, down the sloped surface of the panel, and covers the tip of the plow. A sealant bead is placed within the channel on its lower wall. When the opposing edges of adjacent panels are fully interengaged, the portion of compressible foam at the tip of the plow and the portion of the foam on the outer panel surface are each compressed by corresponding locations on the channel to form a pair of watertight seals. In addition, the sealant bead is displaced by the plow as the plow enters the channel, until the sealant bead fills the region between the plow and the channel, thereby forming a third seal. A fourth seal is optionally added at an overlap seam formed between the upper channel wall and the outer panel surface, such fourth seal providing a visible cue of the completeness of the seal between the opposing panel edges.

23 Claims, 2 Drawing Sheets

ROOF PANEL WITH PLOW-SHAPED EDGE AND RELATED ROOF PANEL SYSTEM

FIELD OF THE INVENTION

The present invention relates to thermally insulative, interlocking roof panels which create a roof structure and, more particularly, to such panels which have an improved interlocking system.

DESCRIPTION OF THE PRIOR ART

Roof constructions which make use of a plurality of interlocking, thermally insulative roof panels have been devised for new roofs, pre-existing roofs, or any other roof-like substrate, whether dead level flat or pitched. U.S. Pat. Nos. 4,244,151 and 5,394,672, by the same inventor as the present application, disclose two such roof-panel systems.

Nonetheless, it is desirable to make the roof panels of such systems not only easy to manufacture and handle, but also easy to install and effective at creating watertight seals between adjacent panels to keep out the onslaught of rain, hail, snow, heat, and other environmental factors. Prior roof panel systems which are easy to interlock often create inadequate seals between opposing panel edges. On the other hand, roof panels which create better watertight seals are often more complicated to interlock or install, and may be more difficult to manufacture, making the panels more expensive. Panels which are difficult to install correctly are all the more troublesome when in the hands of inexperienced tradesmen, with the result that the integrity of the roof system winds up being compromised either immediately or in an unacceptably short period of time.

A related disadvantage of some of the prior roof panel systems is that the seals and interlocking devices of opposing edges are hidden from the view of the installer. This means that a roof installer, even if experienced, may find him- or herself without sufficient visual cues that the roof panels have been correctly interlocked. The absence of such visual cues, at best, makes the installer uncertain that the panels have been correctly interlocked, thus slowing the installation process. At worst, the absence of visual cues, again, results in the roof panel system being incorrectly installed, and thus, ineffective at keeping out the environmental elements as discussed previously.

Certain roof panel systems make use of resiliently compressible foam to seal opposing edges of adjacent, interengaged panels. Generally, to form the required seal, the opposing panel edges are moved or forced toward each other to compress the resiliently compressible foam. In reaction to such compression, however, outwardly directed forces are experienced between the adjacent panel edges. Such outwardly directed forces may make installation more difficult, and may compromise the effectiveness of the seal between the opposing panel edges.

The top and bottom surfaces of earlier panels generally terminate in edges which are coextensive with each other. Examples of such edge configurations are shown in U.S. Pat. No. 4,360,553 [Landheer] and U.S. Pat. No. 4,186,539 [Harmon]. Such earlier panels are generally not well suited for placement directly over frame structures, such as laterally spaced rafters, because the co-extensive edges of the opposing panels do not provide sufficient horizontal support for the roof structure. Otherwise stated, forces orthogonal to the planar surfaces of the panels may tend to cause the joints between the panels to laterally flex when such joints occur between the supporting members of an underlying roof frame. Such lateral flexion complicates or renders impossible the installation of many earlier roof panel systems on such open frame structures.

There is, thus, a need for roof panels and associated roof panel systems which are not only easy to manufacture and install, but which also create effective seals between opposing edges of interengaged panels to keep out water and other environmental factors.

There is a further need for such a roof panel system to provide visual cues to the installer so that such installer knows installation has been correctly performed.

There is a still further need for the watertight seal between opposing panel edges to be accomplished without generating undue amounts of outward forces between the opposing panel edges.

There is a still further need for the opposing panel edges to be configured so that an optimal seal between opposing edges can be made with or without a horizontal underlayment or substrate, such as when the panel joint is located between laterally spaced rafters of a roof frame.

SUMMARY OF THE INVENTION

A panel, according to the present invention, has structures which interengage with one or more adjacent panels to form a roof for a structure. The inventive panel includes a first substantially planar surface which faces outward, as well as a second, opposite surface which faces towards the structure for which a roof is being created. A sloped surface, which defines a plow, extends outwardly from at least one edge of the outwardly facing surface and slopes toward the inwardly facing surface. The sloped surface terminates in an outwardly oriented tip. A first seal is secured to the outwardly facing surface next to the plow. The first seal extends slightly above the plane of the first surface. A second seal is secured to the sloped surface and is positioned so that the second seal covers the tip of the sloped surface. The first and second seals are located and structured so that they engage corresponding locations on an opposing edge of an adjacent panel, thus forming a pair of watertight seals between the opposing edges of the panels.

In accordance with another aspect of the present invention, the seals comprise a layer of resiliently compressible foam. When one panel is interengaged with another panel by moving the panels towards each other, the first seal resiliently compresses in the direction substantially perpendicular to the plane of the panels, and the second seal resiliently compresses in a direction substantially parallel to the plane of the panels. In this manner, the sloped surface remains substantially free of forces which would otherwise tend to separate the interengaged panels, except for the resilient compression of the second seal.

In accordance with yet another aspect of the present invention, the sloped surface has a slope less than one in relation to the tip, so that the angle of the tip of the plow is acute.

A plurality of panels form a roof panel system, according to the present invention. In such system, the plow of one panel interengages into a channel formed in the opposing edge of one or more adjacent panels. The channel includes upper and lower channel walls extending essentially parallel to the respective planes of the outer and inner surfaces of the panels, as well as a channel base extending between, and essentially transversally to, the above-described channel walls. The plow of the one panel is sized to be conformably received in the channel, wherein the first resiliently compressible foam seal engages the upper channel wall and the second resiliently compressible foam seal engages the base of the channel, thereby forming a pair of watertight seals between the two panels. The first foam portion resiliently compresses against the upper channel wall in a direction substantially perpendicular to the plane of the panels, whereas the second foam portion resiliently compresses in a direction substantially parallel to the plane of the panels. In this way, the sloped surface, when engaged in the above-described channel, remains substantially free of forces tending to separate the interengaged panels, except for the resilient compression of the second foam, resiliently compressible seal.

In accordance with still another aspect of the present invention, a bead of sealant is disposed on the inner surface of the lower channel wall. The bead is located such that, when the plow of one panel edge engages the channel of the opposing edge of another, adjacent panel, the tip of the plow displaces the sealant bead from the lower channel wall toward the upper channel wall. In one preferred embodiment, a region is defined between the plow of one panel and the opposing inner surface portions of the channel in which the plow is received. The region has a volume selected so that the above-described sealant bead, when displaced toward the upper channel wall, substantially fills the region when the panels are fully interengaged.

In accordance with yet another aspect of the invention, the upper channel wall preferably extends a preselected distance past the second seal to define an overlap seam between the upper channel wall and the corresponding outer panel surface. In this way, the overlap seam is readily visible when the opposing edges of the adjacent panels are fully interengaged, and an additional sealant bead can be applied to the overlap seam to provide a visual indication of the completeness of the seal between the opposing edges of the adjacent panels.

BRIEF DESCRIPTION OF THE DRAWINGS

For the purpose of illustrating the patent, there is shown in the drawings forms which are presently preferred; it being understood, however, that the invention is not limited to the precise arrangements and instrumentalities shown.

DETAILED DESCRIPTION OF THE INVENTION

The following detailed description is of the best presently contemplated mode of carrying out the invention. This description is not intended in a limiting sense, but is made solely for the purpose of illustrating the general principles of the invention. The various features and advantages of the present inventions may be more readily understood with reference to the following detailed description, taken in conjunction with the accompanying drawings, wherein like numbers refer to the same feature or part thereof.

Figure 1:
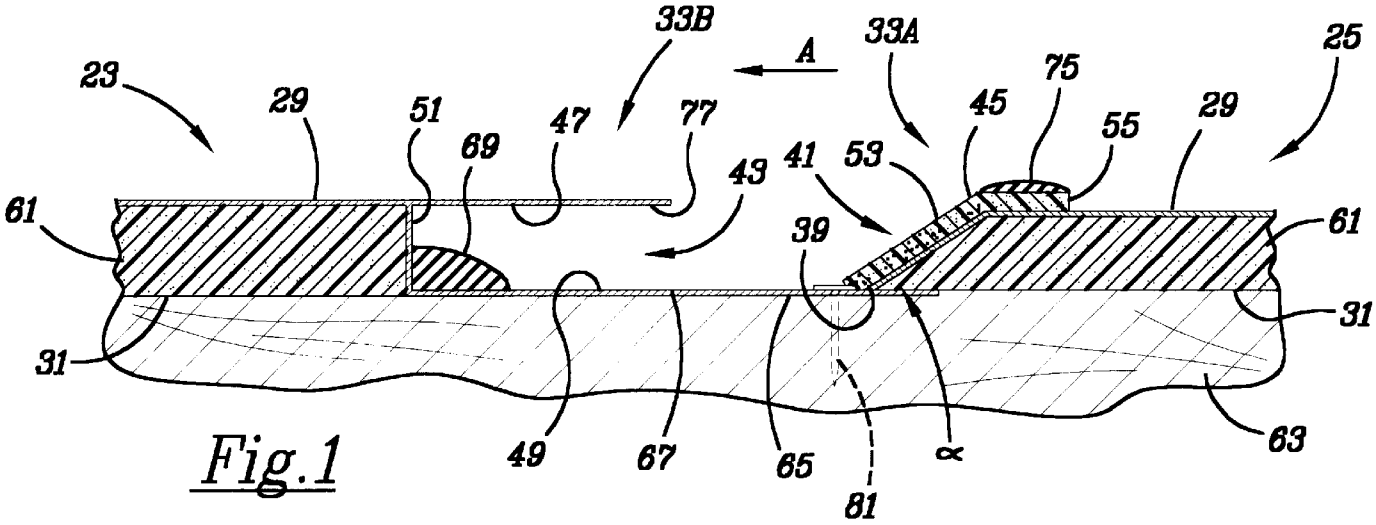
FIG. 1 is a side elevational, cross-sectional view of opposing edges of two panels of a roof system according to the present invention, prior to such panels being fully interengaged.
Figure 2:
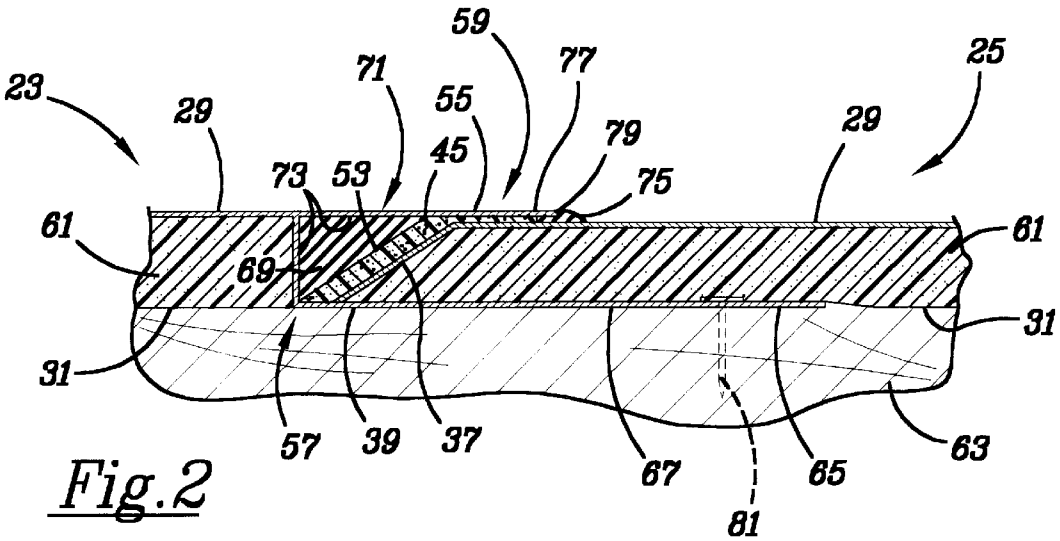
FIG. 2 is a side elevational, cross-sectional view of the two panel edges of FIG. 1 when fully interengaged.
Figure 3:
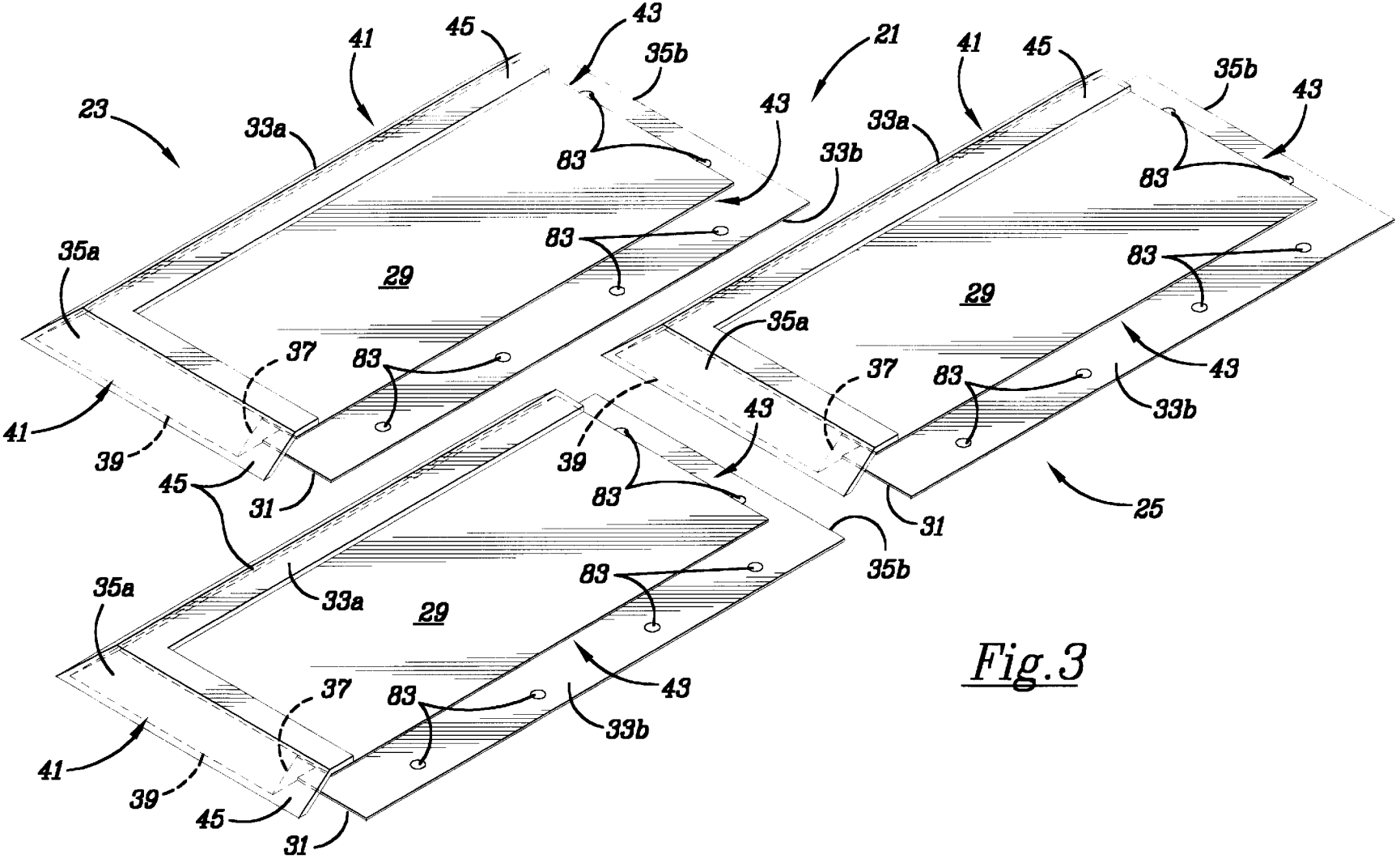
FIG. 3 is a roof panel system according to the present invention, showing three of the panels thereof.

Referring now to FIGS. 1–3, and in particular to FIG. 3, there is shown a roof panel system 21 of which three roof panels 23, 25, 27 are shown. Each of the panels 23, 25,27 has an outer surface 29 corresponding to the outside of the roof, and an inner surface 31 corresponding to the underside of the roof. The panels 23, 25, 27 terminate in respective pairs of opposite side edges 33*a*, 33*b* and opposite end edges 35*a*, 35*b*.

Although the panels 23, 25,27 are shown in spaced-apart relationship to each other in FIG. 3, the panels are assembled into a roof by interengaging opposing edges 33*a*, 33*b* or 35*a*, 35*b* of adjacent ones of the panels 23, 25, 27, as described subsequently. The term "interengage," when used herein, denotes the receiving of one or more panel edges into the corresponding panel edge or edges of an adjacent panel or panels.

Referring now generally to FIGS. 1–3, each of the panels 23, 25, 27 has a sloped surface 37 extending outwardly from side edge 33*a* and from end edge 35*a*. Sloped surface 37 extends downwardly from outer surface 29 to inner surface 31 for each of the panels 23, 25, 27, and terminates in respective outwardly oriented tips 39. In this embodiment, the tips 39 lie essentially in the plane of respective inner surfaces 31. The tips 39 also correspond to the outermost extremities of respective edges 33*a*, 35*a* in which the tips 39 are formed. The sloped surfaces 37 and tips 39 define plows 41 at the corresponding edges 33*a*, 35*a* of panels 23, 25, 27.

Channels 43 are formed along edges 33*b*, 35*b*, opposite corresponding plows 41 in each of the panels 23, 25, 27. When edges 33*a* are interengaged in edges 33*b*, and edges 35*a* are interengaged in edges 35*b*, the corresponding plows 41 are received in corresponding channels 43.

The interengagement of opposing edges 33*a*, 33*b* and 35*a*, 35*b* is discussed in more detail with reference to FIGS. 1 and 2, which show opposing edges 33*a* and 33*b* of panels 23 and 25, respectively. A layer 45 of resiliently compressible foam is secured to each of the edges 33*a* (and 35*a* in FIG. 3) so that it extends above the plane of outer surface 29 immediately adjacent to plow 41. Layer 45 substantially covers the sloped surface 37 in this embodiment and terminates at and covers corresponding tip 39.

The channel 43 formed in opposing edge 33*b* conformably receives plow 41 therein between its upper and lower channel walls 47, 49 respectively. Channel walls 47, 49 extend essentially parallel to respective planes of outer and inner surfaces 29, 31 of the panels 23, 25, 27. In this embodiment, upper channel wall 47 is substantially coplanar with outer surface 29 and the lower channel wall 49 is substantially coplanar with inner surface 31. The channel 43 has a base 51 extending between and essentially transverse to channel walls 47, 49.

FIGS. 1 and 2 show a pair of opposing side edges 33*a* and 33*b* in corresponding panels 25 and 23, respectively. To interengage the opposing edges 33*a*, 33*b*, panels 23 and 25 are slid toward each other in the directions indicated by the arrows A (FIG. 1), such direction being substantially parallel to the horizontal plane defined by such panels. When the opposing edges 33*a*, 33*b* are fully engaged, portion 53 of foam layer 45 on outer surface 29 adjacent to plow 41 is resiliently compressed by contact with upper channel wall 47 in a direction substantially perpendicular to the horizontal plane defined by the panels 23, 25. A second portion 55 of foam layer 45 located at tip 39 of plow 41 is resiliently compressed by contact with base 51 in a direction substantially parallel to the horizontal plane defined by panels 23, 25. Such contact between portions 53, 55 of layer 45 and corresponding portions of channel 43 form a pair of watertight first and second seals 57, 59 between the opposing edges 33*a*, 33*b* of corresponding panels 25 and 23. In addition, the above-described interengagement of resiliently compressible foam layer 45 and channel 43 allows sloped surface 37 to remain substantially free of force components opposite the arrows A which forces would tend to separate the interengaged edges 33*a*, 33*b* shown in FIG. 2. Otherwise stated, foam layer 45 is generally only compressed in the horizontal direction in a region corresponding to portion 55 at tip 39 of plow 41.

Outer and inner surfaces 29, 31 preferably comprise a metal skin which surrounds a core 61 made out of any suitable combination of reinforcing and/or thermally protective materials. Suitable thermally protective materials include polyurethane foam and polystyrene foam; suitable reinforcing materials include wood, masonite and cementatious materials.

The lower channel wall 49 of channel 43 extends outwardly a predetermined distance beyond the outermost edge of upper channel wall 47. Suitable means, here shown as nailing hem 65, are provided in the lower channel wall 49 for securing the panel 23 to a suitable substrate 63 of the roof (not shown). The extension of lower channel wall 49 also facilitates assembly of adjacent panels by providing a support surface 67 against which plow 41 can be received during such installation. Such support surface 67 is especially important in applications where there is otherwise minimal or no horizontal support between opposing panel edges, such as when no substrate 63 is present.

Plow 41 is preferably structured so that sloped surface 37 has a slope less than one (as measured from tip 39). In this way, the angle $\alpha$ is acute, which, again, minimizes the amount of horizontal, outwardly directed force components exerted against sloped surface 37 when the opposing edges 33*a*, 33*b* are fully interengaged.

Channel 43 preferably has a bead 69 of sealant disposed on the inner surface of lower channel wall 49. Bead 69 is located so that plow 41 of the opposing panel edge 33*a* will displace bead 69 from lower channel wall 49 when the opposing edges 33*a*, 33*b* are interengaged. More particularly, plow 41 will act as a knife edge against bead 69 and will displace it toward upper channel wall 47 and base 51. Most preferably, bead 69 is disposed at the intersection of lower channel wall 49 and base 51.

Bead 69 is preferably applied in situ (job applied), but it may alternately be formed during manufacture of the corresponding panel itself and covered with a removable strip until installation. In either construction, the size of bead 69 is selected so that, once it is displaced by full interengagement of the panels, bead 69 substantially fills region 71 defined between plow 41 and the opposing inner portions 73 of channel 43. The seal 75 between outer surface 29 of panel 25 and upper channel wall 47 of panel 23 is sufficiently strong to inhibit sealant of bead 69 from leaking past seal 75 when bead 69 is displaced as described above.

A second bead 75 of sealant (FIG. 1) is disposed on top of portion 53 of foam layer 45. When opposing edges 33*a*, 33*b* are fully interengaged as shown in FIG. 2, upper channel wall 47 has an end portion 77 which extends over foam portion 53 so as to engage and seal against bead 75. The outer end portion 77 of upper channel wall 47 forms an overlap seam 79 with the underlying portion of outer surface 29. Such overlap seam 79 is visibly sealed by a bead 75 of sealant. Bead 75 is preferably applied in situ (job applied), but may also be applied during manufacture of the panel and preserved for future use by suitable means, such as by a removable strip (not shown) disposed on the outer surface of bead 75.

The panels 23, 25, 27 of roof panel system 21 are assembled to form part of a roof, as now described. When a suitable substrate 63 is available, mechanical fasteners 81 are used to secure edges 33*b*, 35*b* thereto. The fasteners 81 are received in apertures 83 formed in the nailing hems 65. If sealant bead 69 has not been previously installed, it is applied at the intersection of base 51 and lower channel wall 49. Edge 33*a* of an adjacent panel (such as panel 25 or 29) is moved relatively toward corresponding, opposing edge 33*b* (such as that of panel 23 in FIG. 3). Panels of the roof system 21 may be arranged in staggered relationship as illustrated in FIG. 3. Roof system 21 may be used over rafters or other frame structures, or may be disposed directly on an existing roof or substrate thereof.

Referring again more particularly to FIGS. 1 and 2, edges 33*a* and 33*b* are moved toward each other in the direction of arrow A to conformably receive plow 41 within channel 43. Plow 41 is advanced toward base 51 of channel 43 until the portion 55 of foam layer 45 at tip 39 contacts base 51 and is at least partially resiliently compressed thereby. During such advancement of plow 41, the previously applied sealant bead 69 is displaced from its position on lower channel wall 49 shown in FIG. 1 to substantially fill region 71 as shown in FIG. 2. In addition, during such advancement, resiliently compressible portion 53 of foam layer 45 is compressed by contact with upper channel wall 47. As a result, portions 53, 55 form a pair of watertight seals by virtue of their resilient compression against corresponding locations of channel 43. If the second sealant bead 75 has not been previously applied, it is applied to overlap seam 79 after opposing edges 33*a*, 33*b* are fully interengaged. Sealant bead 75 can be readily observed for completion of its seal by the installer.

Although roof panels 23, 25, 27 can have any of a variety of dimensions suitable for various applications, one preferred panel size is 2 feet×4 feet×¼ inch. In one suitable version, outer and inner surfaces 29, 31 comprise an aluminum skin, and core 61 comprises either a wood core or a combination wood and foam core.

The exact configurations of the plow 41 and channel 43 can be varied to suit particular applications. For example, although plow 41 of the illustrated embodiment includes a sloped surface 37 extending linearly and fully between surfaces 29, 31, sloped surface 37 can alternately extend only partially between such surfaces, or sloped surface 37 can be curved or be otherwise non-linear. Similarly, although channel walls 47, 49 are coplanar with respective surfaces 29, 31, they can be located, shaped, and aligned differently, so long as they conformably receive plow 41 therein and form the seals described above.

The advantages of the invention are readily appreciated from the foregoing description. Foam portions 53 and 55 and sealant beads 69 and 75 form four watertight seals between the opposing panel edges 33*a*, 33*b* with a minimum number of installation steps and a minimum amount of sealing material.

This advantageous sealing arrangement is accomplished by structures at the opposing panel edges which are not only relatively straightforward to manufacture, but which are also relatively easy to interengage correctly.

The seals formed by resilient compression of the foam layer 45 are accomplished with a minimal amount of compression in the horizontal direction, thereby minimizing horizontal forces tending to separate the opposing panel edges.

As yet another advantage, the sealant bead at the overlap seam 79 provides a visible cue to the completeness of the seal between the opposing edges, thereby giving on-site installers additional assurance that installation was correct, and providing a "fail-safe" watertight seal between the adjacent panels.

The extended lower channel walls of the panels facilitate installation of the panels on frames or other structures with minimal horizontal surfaces for supporting the panels.

It is to be understood that the above-described embodiments are merely illustrative of the many specific embodiments which represent applications and uses of the present invention. Clearly, numerous other arrangements can be readily devised by those of skill in the art without departing from the spirit and scope of the invention as defined in the appended claims and all changes which are within the scope and equivalency of these claims are intended to be embraced therein.

I claim:

1. A panel for interengaging with another, adjacent panel in a multiple-panel roof system to create a roof for a structure, the panel comprising:

a first substantially planar surface which is adapted to face outward and a second, opposite, substantially planar surface adapted to face toward the structure, the surfaces terminating in edges;

a sloped surface extending outwardly from at least one edge of the first surface toward the second surface and terminating in an outwardly oriented tip, the sloped surface and tip defining a plow;

a first seal secured to the first surface immediately adjacent to the plow and extending above the plane of the first surface, and a second seal secured to the sloped surface to cover the tip thereof; and the first and second seals engaging corresponding locations on the adjacent panel to form a pair of watertight seals between the panel and the adjacent panel.

2. The panel of claim 1, wherein the sloped surface extends substantially linearly and downwardly to the second surface, so that the tip lies substantially in the plane of the second surface.

3. The panel of claim 1, wherein the first and second seals comprise portions of a layer of sealant extending from the first surface adjacent the plow, covering the sloped surface, and terminating at the tip.

4. The panel of claim 1, wherein the seals comprise resiliently compressible foam.

5. The panel of claim 4, in which the panel is interengaged with the adjacent panel by moving the panels toward each other in a direction substantially parallel to a plane defined by the panels, wherein, as the seals engage the corresponding locations of the adjacent panel, the first seal resiliently compresses in a direction substantially perpendicular to the plane of the panels, the second seal resiliently compresses in a direction substantially parallel to the plane of the panels, and the sloped surface remains substantially free of forces tending to separate the interengaged panels, except for said resilient compression of the second seal.

6. The panel of claim 1, wherein the sloped surface has a slope less than one in relation to the tip, so that the angle at the tip of the plow is acute, and wherein the tip comprises the outermost point of the edge in which it is formed.

7. The panel of claim 1, wherein the panel surfaces together form a metal skin surrounding a core selected from the group consisting of at least one of a reinforcing material and a thermally protective material.

8. The panel of claim 7, wherein the reinforcing material is selected from the group consisting of wood, masonite, and cementatious materials.

9. The panel of claim 7, wherein the thermally protective material is selected from the group consisting of polyurethane foam and polystyrene foam.

10. The panel of claim 1, wherein the panel comprises two pairs of the edges, namely one pair of opposite side edges and one pair of opposite end edges, the plow being defined in one of the side edges and one of the end edges.

11. A panel of a roof system for interengaging with other, adjacent panels, the panel assembled into a roof by interengaging opposing edges of adjacent ones of the panels, the panel comprising:

a core selected from the group consisting of at least one of a reinforcing material and a thermally protective material;

a metal skin surrounding the core, the skin comprising a first substantially planar surface which is adapted to face outward and a second, opposite, substantially planar surface adapted to face toward the structure, the panel terminating in one pair of opposite side edges and one pair of opposite end edges, a sloped surface extending outwardly from the first surface at one of the side edges and one of the end edges, the sloped surface extending downwardly to the second surface and terminating in respective outwardly oriented tips, the tips lying substantially in the plane of the second surface, the sloped surfaces and tips defining respective plows at the corresponding edges of the panel, the sloped surfaces having respective slopes less than one in relation to the tips, so that the angles at the tips of the plows are acute, and wherein the tips comprise the outermost points of the respective edges in which the tips are formed;

a layer of resiliently compressible foam secured to each of the sloped surfaces, each of the foam layers having a first foam portion covering the first surface adjacent to the plow and a second foam portion covering the tip of the plow, the first foam portions extending above the plane of the first surface;

wherein the first and second foam portions engage corresponding locations on opposing edges of the adjacent panels to form a pair of watertight seals between the panel the adjacent panels; and wherein the panel is interengaged with the adjacent panels by moving the panels toward each other in a direction substantially parallel to a plane defined by the panels, the first foam portions resiliently compressing in a direction substantially perpendicular to the plane of the panels and the second foam portions resiliently compressing in a direction substantially parallel to the plane of the panels when the foam portions engage the corresponding locations of the adjacent panels, the sloped surfaces remaining substantially free of forces tending to separate the interengaged panels, except for said resilient compression of the second foam portions.

12. A roof panel system having a plurality of panels, each panel having an outer surface corresponding to the outside of the roof and an inner surface corresponding to the underside of the roof, the panels terminating in respective edges, the panels assembled into a roof by interengaging opposing edges of adjacent ones of the panels, the roof panel system comprising:

a sloped surface extending outwardly from at least one of the edges of a first panel, the sloped surface extending downwardly from the outer surface to the inner surface and terminating in an outwardly oriented tip, the tip lying essentially in the plane of the inner surface;

a plow defined by the sloped surface and the tip;

a channel formed along at least one of the edges of a second panel and positioned to oppose the plow of the first panel, the plow being received in the channel when the edges are interengaged;

a layer of resiliently compressible foam secured to the plow, the layer having a first portion covering a portion of the outer surface adjacent to the plow and a second portion covering the tip of the plow, the layer having a thickness, so that the first portion of the compressible foam extends above the plane of the outer surface and the second portion extends beyond the tip;

the channel comprising upper and lower channel walls extending essentially parallel to the respective planes of the outer and inner surfaces of the panels, and a base extending between, and essentially transversely to, the channel walls;

the plow being sized to be conformably received in the channel, wherein the first foam portion engages the upper channel wall and the second foam portion engages the base of the channel to form a pair of watertight seals between the first and second panels; and the first foam portion resiliently compressing against the upper channel wall in a direction substantially perpendicular to the plane of the panels, the second foam portion resiliently compressing in a direction substantially parallel to the plane of the panels, the sloped surface, when engaged in the channel, remaining substantially free of forces tending to separate the interengaged panels, except for said resilient compression of the second foam portion.

13. The roof panel system of claim 12, wherein the upper channel wall is substantially coplanar with the outer planar surface, and the lower channel wall is substantially coplanar with the inner planar surface.

14. The roof panel system of claim 12, further comprising a bead of sealant disposed on the inner surface of the lower channel wall at a location thereon such that, when the plow of the first panel engages the channel of the second panel, the tip of the plow displaces the sealant bead from the lower channel wall toward the upper channel wall.

15. The roof panel system of claim 14, wherein the sealant bead is disposed at the intersection of the lower channel wall and the base.

16. The roof panel system of claim 14, wherein a region is defined between the plow and the opposing inner surface portions of the channel in which the plow is received, the region having a first boundary corresponding to the intersection of the upper channel wall and the base and a second boundary corresponding to the sloped surface, whereby the volume of the region is determined by the contours of the first and second boundaries.

17. The roof panel system of claim 16, wherein the slope of the sloped surface, and the size of the sealant bead, are selected to fill substantially the volume of the region when the panels are interengaged.

18. The roof panel system of claim 17, wherein the contact between the second sealant portion and the upper channel wall is sufficient to inhibit sealant from the sealant bead from leaking past the upper channel wall.

19. The roof panel system of claim 12, further comprising an overlap seam defined by a portion of the upper channel wall extending over the second foam portion, the overlap seam being readily visible when the edges are fully interengaged; and an additional sealant bead disposed in the overlap seam, the completeness of said additional sealant bead being visible after installation of the first and second panels is completed.

20. The roof panel system of claim 12, wherein the lower channel wall includes means for securing the panel to the structure.

21. The roof panel system of claim 20, wherein the securing means comprises a nailing hem.

22. The roof panel system of claim 12, wherein the lower channel wall extends a predetermined distance beyond the outer edge of the upper channel wall to define an extended portion, the extended portion supporting the first panel during interengagement with the second panel.

23. The roof panel system of claim 12, wherein each of the panels comprises a pair of opposite side edges and opposite end edges, wherein a plow is formed in one of the side edges and one of the end edges, and a channel is formed in the other of the side edges and the other of the end edges.

* * * * *